US005168941A

United States Patent [19]

Krueger et al.

[11] Patent Number: 5,168,941

[45] Date of Patent: Dec. 8, 1992

[54] DRILLING TOOL FOR SINKING WELLS IN UNDERGROUND ROCK FORMATIONS

[75] Inventors: Volker Krueger, Celle; Hans-Juergen Faber, Neustadt; Dagobert Feld, Hanover, all of Fed. Rep. of Germany

[73] Assignee: Baker Hughes Incorporated, Del.

[21] Appl. No.: 704,030

[22] Filed: May 22, 1991

[30] Foreign Application Priority Data

Jun. 1, 1990 [DE] Fed. Rep. of Germany ..... 4017761
Aug. 21, 1990 [EP] European Pat. Off. ..... 90115963

[51] Int. Cl.[5] ..... E21B 7/04
[52] U.S. Cl. ..... 175/26; 175/76
[58] Field of Search ..... 175/24, 26, 45, 61, 175/73, 76

[56] References Cited

U.S. PATENT DOCUMENTS

| | | | |
|---|---|---|---|
| 2,796,234 | 6/1957 | Mann | 175/76 |
| 3,092,188 | 6/1963 | Farris et al. . | |
| 3,141,512 | 7/1964 | Gaskell et al. | 175/26 |
| 3,196,959 | 7/1965 | Kammerer . | |
| 3,424,256 | 1/1969 | Jeter . | |
| 3,554,302 | 1/1971 | Adkins et al. | 175/26 |
| 3,593,810 | 7/1971 | Fields | 175/61 |
| 3,595,326 | 7/1971 | Claycomb | 175/73 |
| 3,888,319 | 6/1975 | Bourne et al. | 175/76 |
| 4,185,704 | 1/1980 | Nixon, Jr. | 175/76 |
| 4,241,796 | 12/1980 | Green et al. | 175/76 X |
| 4,394,881 | 7/1983 | Shirley | 175/76 |
| 4,407,374 | 10/1988 | Wallussek et al. | 175/24 |
| 4,635,736 | 1/1987 | Shirley | 175/76 |
| 5,000,272 | 3/1991 | Wiebe et al. | 175/73 |
| 5,038,872 | 8/1991 | Shirley | 175/76 |

FOREIGN PATENT DOCUMENTS

| | | | |
|---|---|---|---|
| 2230288 | 10/1990 | United Kingdom | 175/76 |

OTHER PUBLICATIONS

Anadrill/Schlumberger Advertisement "Save Trips With One Simple Tool" (Undated).
Schwing Hydraulik Electronik GmbH & Co. Brochure "Directional Drilling Technique" (Undated).

*Primary Examiner*—William P. Neuder
*Attorney, Agent, or Firm*—Joseph A. Walkowski

[57] ABSTRACT

The present invention provides an apparatus for orienting a drilling tool in a borehole, and which employs drilling mud pressure to selectively hydraulically move force-transmitting elements associated with pressure members on the exterior of the tool against the wall of the borehole, or to radially shift the drive shaft of the drilling tool in the tool casing. The tool may also include a drilling mud powered centering mechanism for maintaining the tool or the drive shaft within the tool in a centered basic position. A tool may include both pressure members and a shiftable drive shaft, as well as centering mechanisms to act on both the pressure members and the drive shaft.

32 Claims, 8 Drawing Sheets

DRILLING TOOL FOR SINKING WELLS IN UNDERGROUND ROCK FORMATIONS

BACKGROUND OF THE INVENTION

1. Field of the Invention

This invention concerns a drilling tool for sinking wells in underground rock formations, where the direction for drilling can be selected.

2. State of the Art

In a known version of such a drilling tool, a sealed hydraulic system with a hydraulic reservoir and a hydraulic pump is accommodated in the drilling tool to act on force-transmitting elements. The force-transmitting elements act on control runners that are pressed against the wall of the borehole.

SUMMARY OF THE INVENTION

This invention is based on the problem of creating a drilling tool of the type described above with an essentially simplified hydraulic system for controlling the force-transmitting elements.

The drilling tool according to this invention uses the drilling mud which is already present in the borehole as the hydraulic medium to impart the required directional forces, so this greatly simplifies the design of the tool. The hydraulic pressure chambers of the force-transmitting elements preferably have a flow passing through them at all times, at least apart from periodic interruptions, so the accumulation of sediment is effectively prevented.

The force-transmitting elements can induce a displacement of the outer casing of the drilling tool together with the tool drive shaft, but instead of this the tool drive shaft can also be supported so it can be shifted radially to a limited extent in the outer casing and can be shifted from one position in the outer casing into another position for directional purposes by means of a number of force transmitting elements distributed around the periphery. Such a design shifts the movement of components which is necessary for a change in direction into the interior of the drilling tool, thereby simplifying the design of the outer casing.

BRIEF DESCRIPTION OF THE DRAWINGS

Numerous other details and advantages are derived from the following description and the figures which illustrate several practical examples of the object of this invention in schematic detail. The figures show the following.

DESCRIPTION OF THE PREFERRED EMBODIMENT

Figure 1:
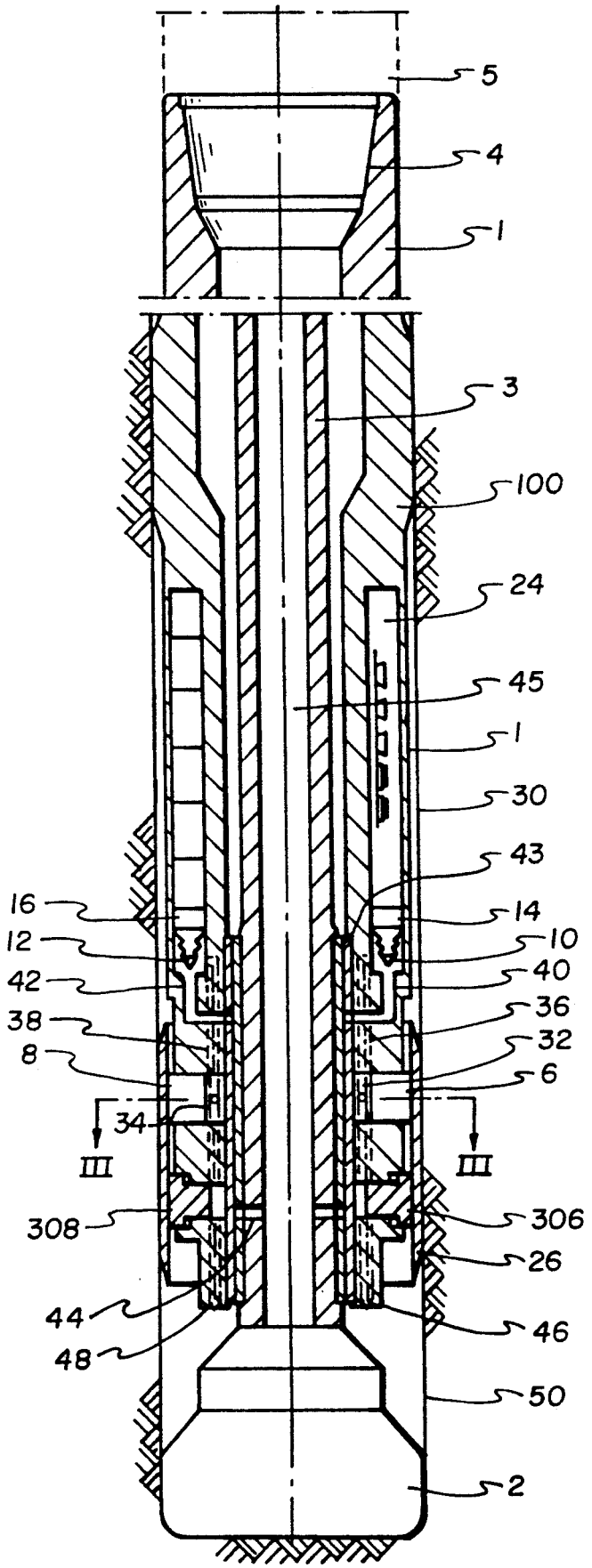
FIG. 1 shows a cutaway schematic diagram of a drilling tool according to this invention with force-transmitting elements which act on the pressure pieces that can be applied to the wall of the borehole (shown in a longitudinal sectional view)

FIG. 1 illustrates a drilling tool for sinking wells in underground rock formations where the drilling tool consists of an outer casing 1 with a stabilizer 100 and a drive shaft 3 that rotates in outer casing 1 and carries rotary drill bit 2 on its projecting end. Outer casing 1 can be connected to a drill string 5 as indicated schematically in FIGS. 1 and 2 by connecting means, especially an upper connecting thread 4 as illustrated in the drilling tool according to FIGS. 1 and 2, so that drilling mud can be supplied to the drilling tool through the drill string. The drive shaft 3 of the drilling tool is driven by a hydraulic drive motor (not shown), e.g., a Moineau motor or a turbine, accommodated in the upper area of the drilling tool in the outer casing 1.

Outer casing 1 is provided with four hydraulically operated force-transmitting elements 6, 7, 8, 9 distributed around its periphery. These force-transmitting elements are arranged in the same plane and form a group. Preferably each drilling tool has several groups of force-transmitting elements 6 to 9 arranged with some spacing between them where preferably the force-transmitting elements that are aligned vertically above each other and act in the same direction are hydraulically controlled together for their joint operation.

Figure 2:
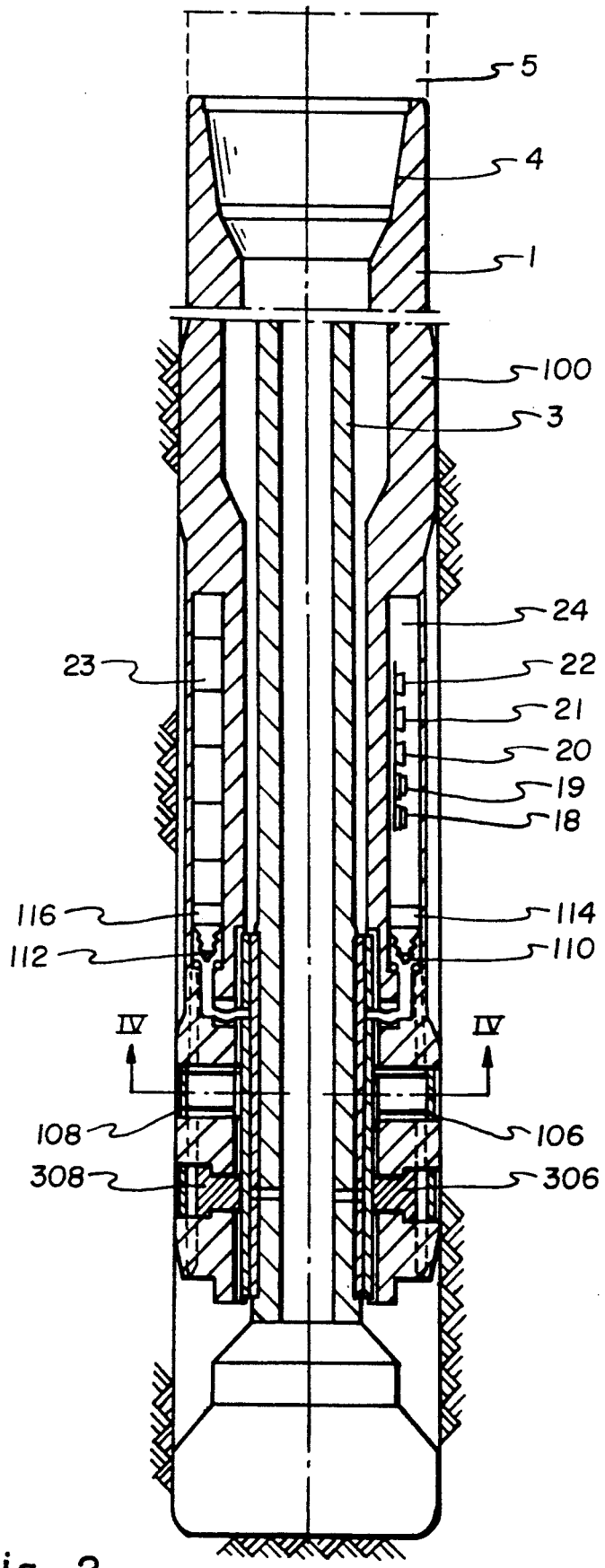
FIG. 2 shows a diagram like FIG. 1 of a drilling tool with the drive shaft of the tool supported so it can move radially to a limited extent in the outer casing and with force-transmitting elements that act on the drive shaft.

For hydraulic operation of force-transmitting elements 6, 7, 8, 9, a control device is provided having an electrically operated control valve for each force-transmitting element or when there are several groups of force-transmitting elements arranged above each other there is one electrically operated control valve for each group of similarly acting force-transmitting elements. FIG. 1 shows only the control valves 10 and 12 for acting on force-transmitting elements 6 and 8 or similarly acting force-transmitting elements. However, it is self-evident that corresponding valves can also be provided for force-transmitting elements 7 and 9. The electromagnets 14, 16 of control valves 10, 12 are connected to a signal generator as indicated schematically by 18 for the drilling tool according to FIG. 2. This signal generator 18 is shown together with another signal generator 19 that may be provided for different control functions as illustrated schematically in FIG. 2 and with a measured value sensor 20 for positional data on the drilling tool is also part of the control system for the force-transmitting elements. In FIG. 2, a measured value sensor is shown schematically at 20 and other measured value sensors 21, 22 for positional data may also be provided, as indicated in FIG. 2. The electric power supply can be provided by batteries 23 which can be accommodated in an annular space 24 of outer casing 1 like the other electric and sensing parts of the control equipment. Instead of a power source provided by batteries 24, power can also be supplied with the help of an electric generator driven by a turbine. The turbine can be operated by drilling mud.

Force-transmitting elements 6, 7, 8, 9 and other corresponding force-transmitting elements that act in the same way and are connected in parallel all act on pressure members 26, 27, 28, 29 which are supported in or on outer casing 1 so they can be shifted inward and outward and can be applied to the wall 30 of the borehole at a central angle of 90° corresponding to the four force-transmitting elements 6, 7, 8, 9.

Each hydraulic pressure chamber 32, 33, 34, 35 for a force-transmitting element 6, 7, 8, 9 can be acted on optionally with drilling mud of a high pressure or drilling mud of a low pressure through a connecting channel 36, 37, 38, 39 and the respective control valve, such as valves 10 and 12 for connecting channels 36 and 38. For this purpose, a feed line is provided above the group of force-transmitting elements 6, 7, 8, 9 for each connecting channel 36, 37, 38, 39. Only feed lines 40, 42 for connecting channels 36 and 38 are illustrated in FIG. 1. These feed lines are controlled by the respective control valve (like control valves 10, 12) and communicate with an annular gap 43 that is connected to drilling mud of a higher pressure by branch line 44 leading to center bore 45 in the drive shaft 3.

Connecting channels 36, 37, 38, 39 each open into the annular space 50 through a throttle point and thus open into an area of drilling mud of a lower pressure as shown in FIG. 1 by 46 and 48 for the connecting channels 36, 38.

In the version according to FIG. 1, a pressure develops in connecting channels 36, 37, 38, 39 and the pressure chambers 32, 33, 34, 35 connected to the former when the control valve is open in the version according to FIG. 1 and this pressure is higher than the pressure established when the control valves (such as 10 and 12) are each closed. In the latter case, a pressure corresponding to the pressure in the drilling mud in the annular space develops in the connecting channels 36, 37, 38, 39 by way of their connection to annular space 50, and this pressure is lower than the pressure of the drilling mud in the drilling tool 1.

In the example illustrated in FIG. 1, connecting channels 36, 37, 38, 39 are each connected between the ends thereof to their respective pressure chamber 32, 33, 34, 35 of the force-transmitting elements 6, 7, 8, 9 by way of a branch channel 56, 57, 58, 59, and the change in pressure in the pressure chambers corresponds to the change in pressure that develops on the whole in the connecting channels 36, 37, 38, 39 which receive drilling mud of a high pressure at one end and drilling mud of a lower pressure at the other end.

Instead of this arrangement, however, it is also possible for two separate connecting channels to be provided for each hydraulic pressure chamber of a force-transmitting elements, where one channel is connected to drilling mud of a higher pressure and the other channel is connected to drilling mud of a lower pressure and a control valve is provided for a connecting channel or channel part that is acted on by either the high or low drilling mud pressure. In certain cases separate control valves can also be provided in both connecting channels or channel parts. This permits a special gradation in pressure, e.g., by means of a differential pressure, especially when the control valves are provided with a valve body that merely reduces the cross section of flow of the valve channel in the closed end position but does not completely seal off the valve channel, which can be desirable in order to maintain a steady flow through the pressure chambers and connecting channels.

In a modification of the communication of the connecting channels 36, 37, 38, 39 to drilling mud of a high pressure and drilling mud of a low pressure as provided in the version according to FIGS. 1 and 2, it is also possible to have the action of the high-pressure drilling mud derive from a drilling mud channel like drilling mud channel 45 in the outer casing 1 in the direction of flow in front of a throttle point and to have the action of low-pressure drilling mud derived from the same drilling mud channel after the throttle point.

Figure 3:
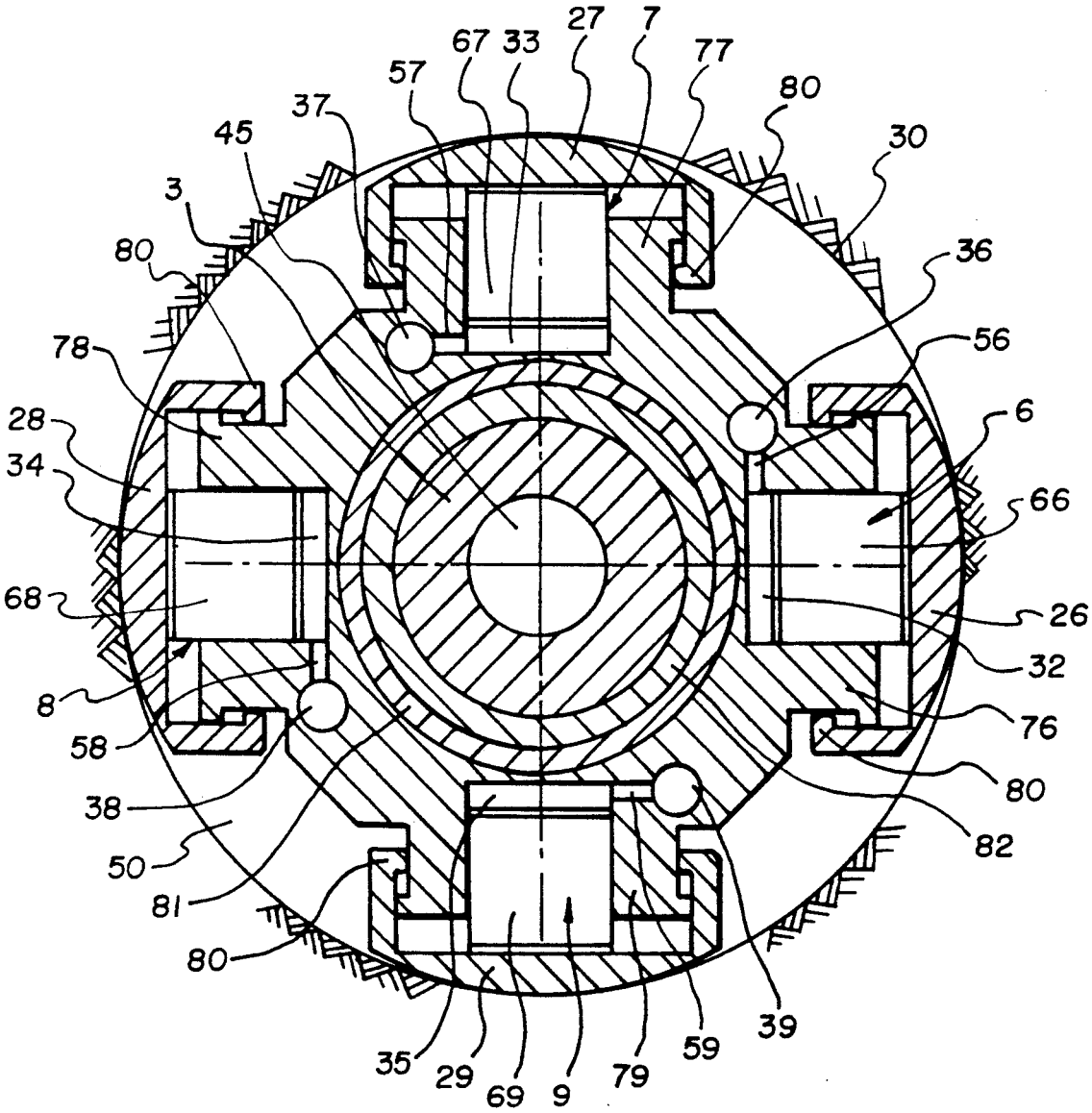
FIG. 3 shows a section along line III—III in FIG. 1.

As an alternative, the action of high-pressure drilling mud can also be derived from the annular space 50 surrounding outer casing 1 in the direction of flow in front of a throttle point for the drilling mud flowing through the annular space and the action with low-pressure drilling mud is derived from the annular space 50 after such a throttle point. Such a throttle point is formed, for example, by a stabilizer. If the force-transmitting elements are pistons 66, 67, 68, 69 (FIG. 3) or 266, 267, 268, 269 (FIG. 5) as is the case with the force-transmitting element 6, 7, 8, 9 and 206, 207, 208, 209 which are held in cylinder spaces in outer casing 1, then the sealing gap between the piston and cylinder can form the connecting channel or channel part that communicates with the low-pressure drilling mud. In this case but also otherwise, the surfaces facing each other are preferably protected with a hard metal.

The control valves preferably have a design with an unbranched valve channel that can be varied only in its cross section of flow and is either released by the valve bodies or is completely or partially closed off in the closed position. The latter design has the advantage that when the control valve is closed, it forms only a throttling element.

The pistons 66, 67, 68, 69 provided in the version according to FIG. 1 act on the inside of pressure members 26, 27, 28, 29 which are designed as stabilizer ribs and are guided on guide projections 76, 77, 78, 79 of outer casing 1 where their movement is limited by stops 80.

In contrast with the version of the drilling tool according to FIG. 1, the drive shaft 3 of the drilling tool in the version according to FIG. 2 is supported so it has limited radial mobility in outer casing 1 and can be shifted from one position in outer casing 1 to another position for directional purposes by means of four force-transmitting elements 106, 107, 108, 109 (FIG. 4) or 206, 207, 208, 209 (FIG. 5) or a multiple thereof when there are several groups acting in parallel. The force-transmitting elements 106, 107, 108, 109 are designed as folded bellows pistons which each surround a pressure chamber 132, 133, 134, 135 that is connected by connecting channels 136, 137, 138, 139 (FIG. 4) to the drilling mud in the manner described above in conjunction with the version described according to FIGS. 1 and 3. This is also true of the version according to FIG. 5 with the connecting channels 236, 237, 238, 239 illustrated there and connected to pressure chambers 236, 237, 238, 239. The arrangement in FIG. 2 of control valves 110, 112 with their electromagnetic drives 114 and 116 also corresponds to that according to FIG. 1.

Of the groups of force-transmitting elements acting on the drive shaft 3 or the pressure members 26, 27, 28, 29, preferably one group of force-transmitting elements is provided for defining a basic position for drive shaft 3 and/or pressure members 26, 27, 28, 29. This group of force-transmitting elements 306, 308, (FIGS. 1 and 6) has stepped pistons 316, 318 that act as centering pistons and move against a stop. In the end position next to the stop, such pistons 316, 318 define a basic position or a centered position for pressure members 26, 27, 28, 29. A similar design with the drilling tool according to FIG. 2 would impart a corresponding basic position or a centered position to drive shaft 3.

The force-transmitting elements 306, 308 that define the basic position, i.e., the centered position for drive shaft 3 and/or pressure members 26, 27, 28, 29, may be hydraulically operated independently of the other force-transmitting elements, either in the sense of separate, independent control or in the sense of constant, uncontrolled activation. In the first case, the force-transmitting elements that determine the centered position can be connected totally or partially to the area of lower pressure drilling mud, in order to minimize the resistance thereof to desired displacement of the drive shaft 3 or outer casing by the other groups of force-transmitting elements. In the second case, the dominant force-transmitting elements for the determination of the centered position form a fail-safe device which, in the case of failure of the control device, ensures that the drilling operation may continue in a linear path. For normal operation it must, however, be ensured that the force-transmitting elements which determine a displacement of the drive shaft 3 or the force-transmitting members (26, 27, 28, 29) in outer casing 1 from their basic positions transfer considerably larger forces out the drive shaft 3 of the present members 26, 27, 28, 29 than the forces applied by the force-transmitting elements determining the original position. This can be accomplished through an appropriate design of the pressure surfaces of the respective force-transmitting elements or by providing several groups of force-transmitting elements for the changes in directions. Such an overcoming of the force-transmitting elements determining the centered position by the force-transmitting elements determining directional displacement can, however, also be obtained with common activation of all force-transmitting elements and common control.

Essentially, it is also possible to combine an external control unit according to FIG. 1 and an internal control unit according to FIG. 2 in one drilling tool, so this permits double control of direction and directional displacement.

Figure 5:
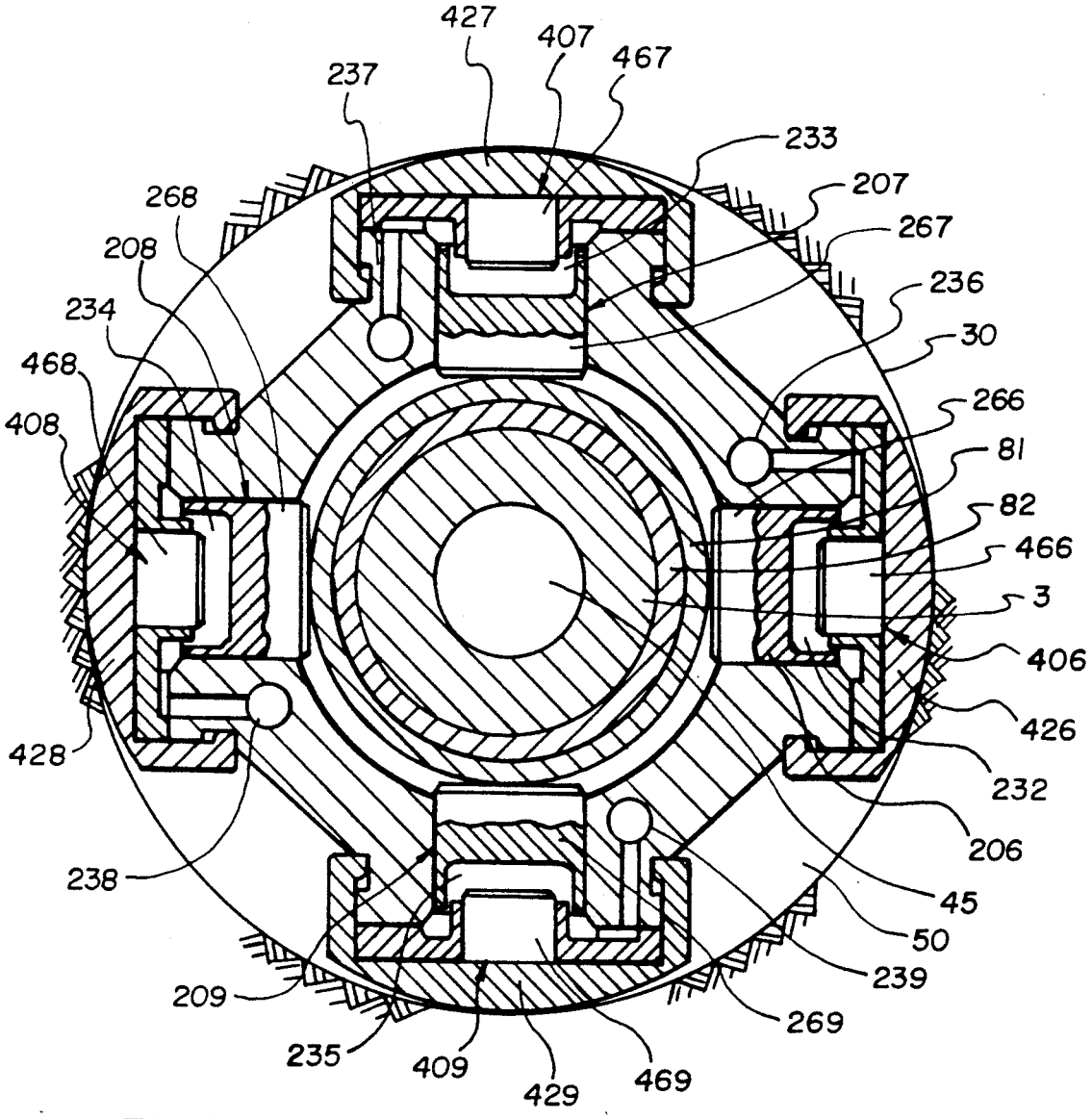
FIG. 5 shows a sectional diagram like FIG. 4 to illustrate a modified version.

The version according to FIG. 5 provides a combined internal and external control system for a drilling tool. Pistons 266, 267, 268, 269 border a pressure chamber 232, 233, 234, 235 at one end which also forms the pressure chamber for pistons 466, 467, 468 and 469 of a force-transmitting element 406, 407, 408, 409 that acts on pressure members 426, 427, 428, 429. These pressure members 426, 427, 428 and 429 may be designed as stabilizer ribs and may be guided along outer casing 1 as described in conjunction with the FIG. 1. Pressure chambers 232, 233, 234, 235 are respectively acted on by drilling mud from connecting channels 236, 237, 238, 239 as described in conjunction with FIG. 1 above.

Figure 4:
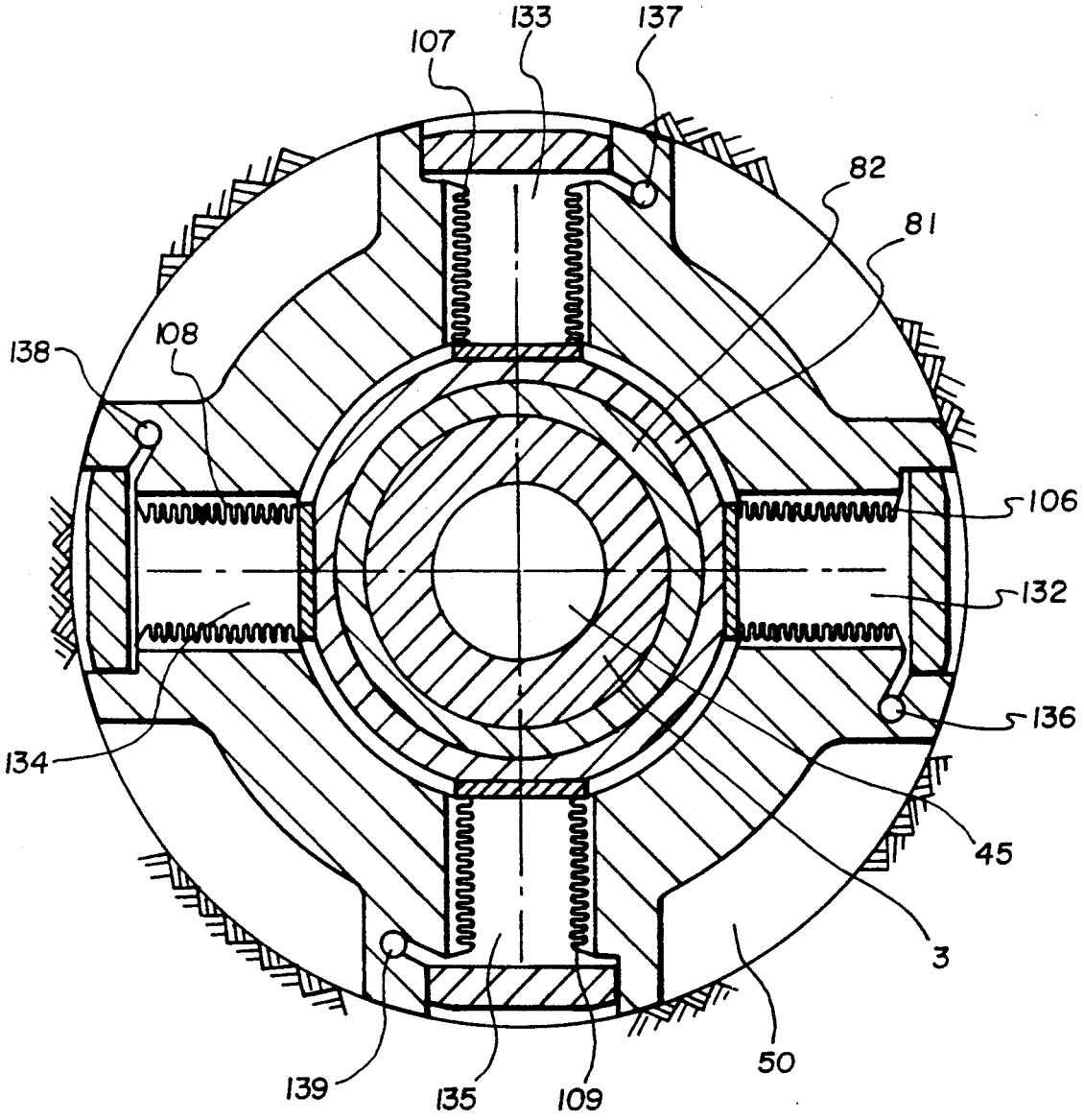
FIG. 4 shows a section along line IV—IV in FIG. 2.

As indicated in FIGS. 2, 4 and 5, the force-transmitting elements 106, 107, 108, 109 and 206, 207, 208, 209 act on a bushing 81 which may have web-like flattened areas in the areas of pressure engagement with the force-transmitting elements. Bushing 81 borders a cylindrical bearing shell 82 in which drive shaft 3 is mounted so it can rotate. Bearing shell 82 may also be a corotational part of drive shaft 3. This prevents wear and improves the load distribution.

Figure 6A:
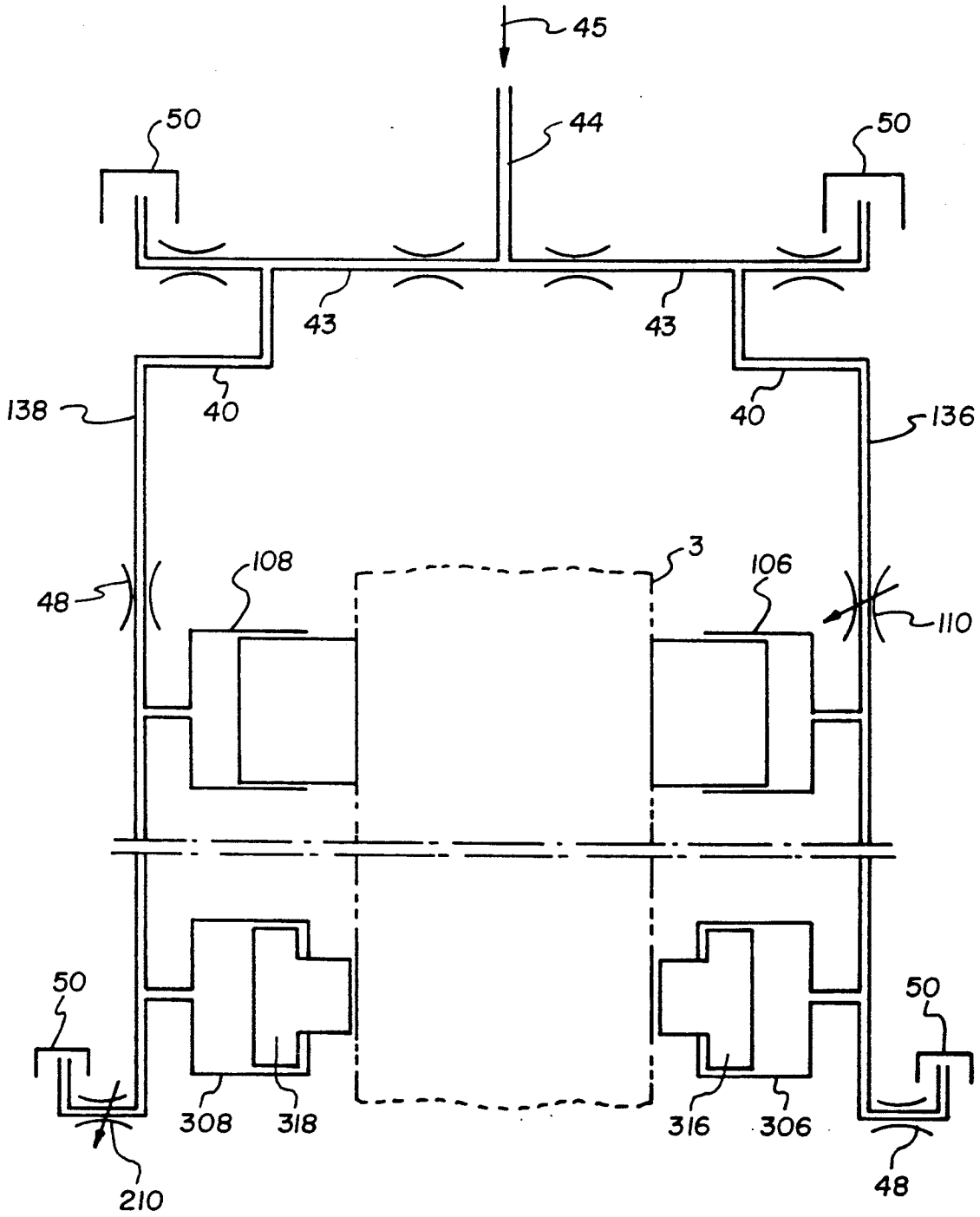
FIG. 6*a* shows a hydraulic circuit diagram for a drilling tool according to FIG. 2 with different control valve locations in the right and left halves.

The right half of FIG. 6*a* shows a hydraulic plan for the embodiment of FIG. 2 with a control valve 110 in the area of connecting channel 136 with a higher drilling mud pressure and the left half of this figure shows a version with an arrangement of a control valve 210 in the area of connecting channel 136 where the drilling mud pressure is lower. In both examples, throttle points 48 are provided in the area of connecting channel 136 not provided with control valves 110, 210 in a manner corresponding to throttle points 48 of FIG. 1.

Figure 6B:
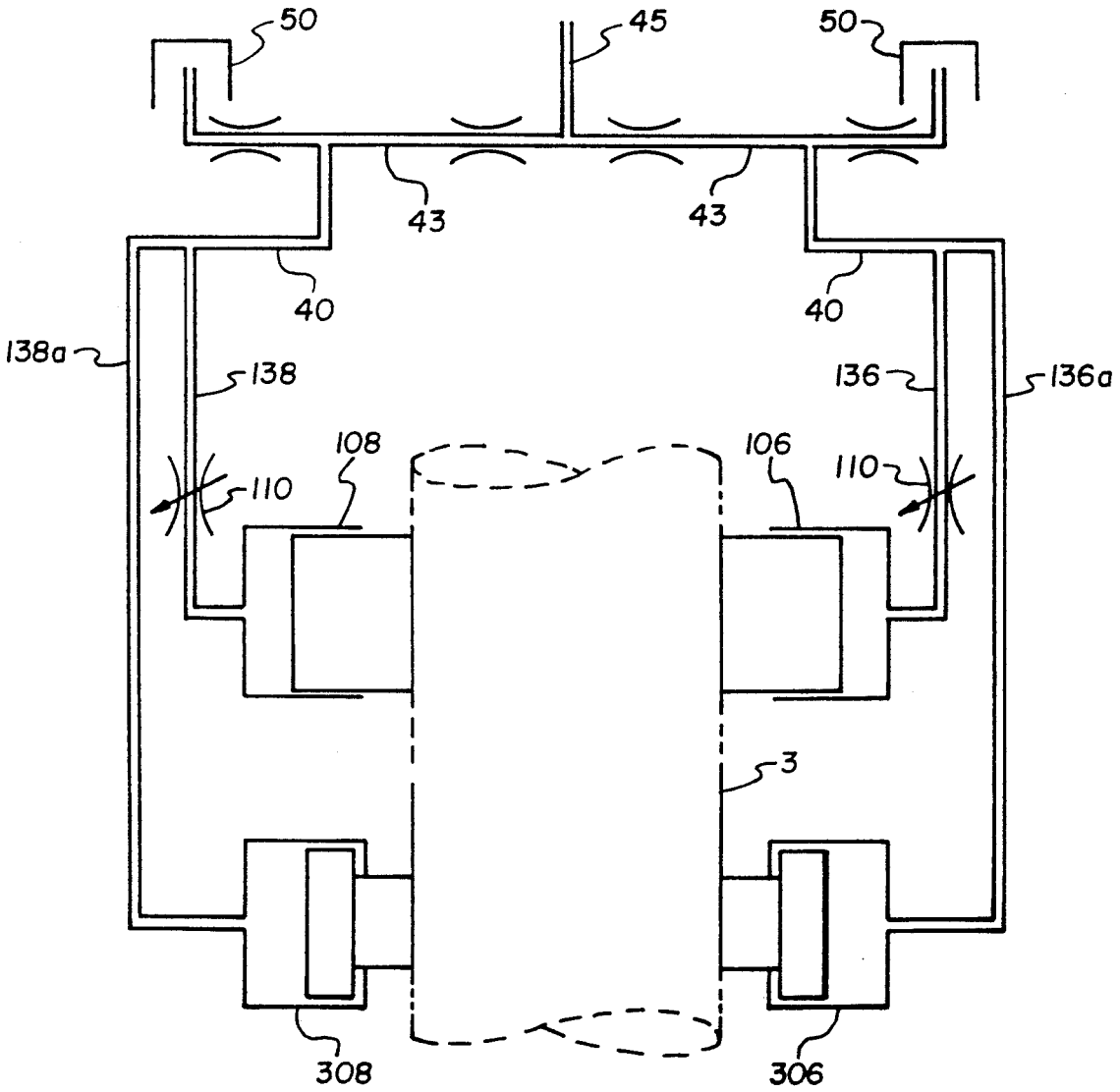
FIG. 6*b* shows a modified hydraulic circuit diagram according to FIG. 2.

FIG. 6*b* represents an activation diagram for an example according to FIG. 2, in which the force-transmitting elements 306, 308 that determine the original position of drive shaft 3 are exposed to an independent, uncontrolled force by a branch channel such as 136*a*, 138*a* that branches off from a connecting channel 136, 138 above its control valve 110. Thus, force-transmitting elements 306, 308 are exposed to a constant activation pressure, which is still effective even if the activation mechanism for the force-transmitting elements 106, 108 should fail, for example as a result of a defect in the electronics of the control device.

Figure 7:
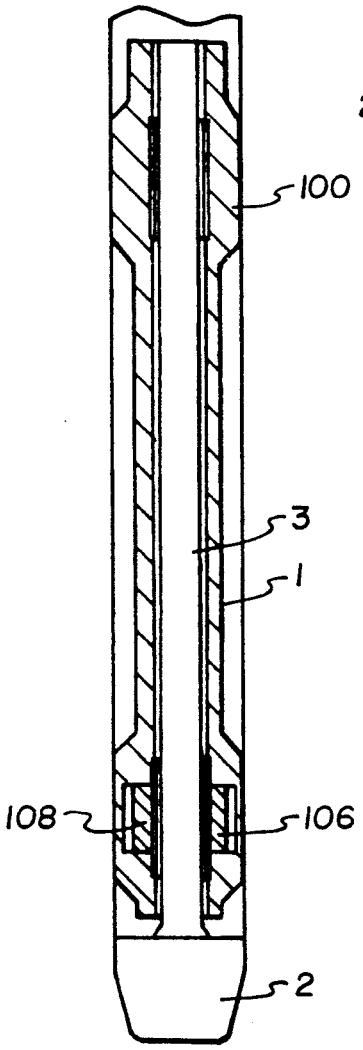
FIGS. 7 to 9 show schematic diagrams of different arrangements of force-transmitting elements in the drilling tool.
Figure 8:
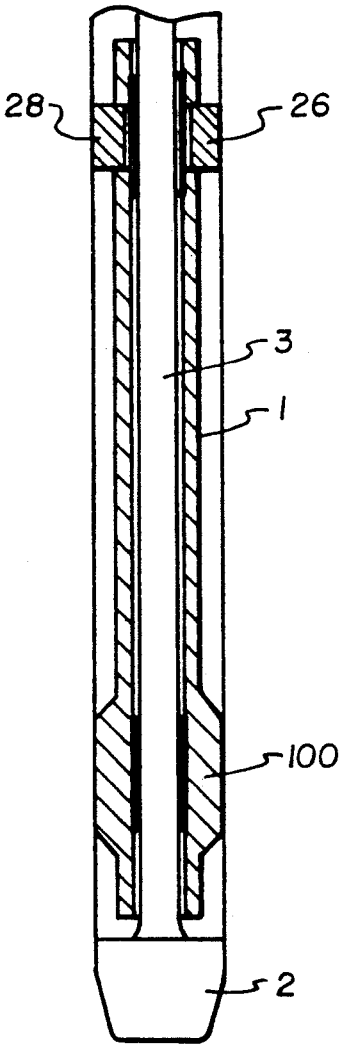
Figure 9:
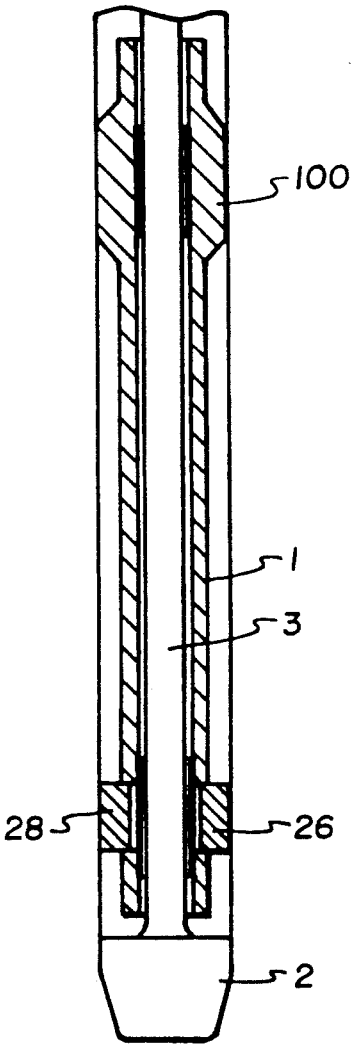

Finally, FIGS. 7, 8 and 9 schematically illustrate variations in the arrangement of the force-transmitting elements within the drilling tool. FIG. 7 shows an arrangement of force-transmitting elements 106, 108 acting on drive shaft 3 close to the drill bit end of the drilling tool, while FIG. 8 shows a version with force-transmitting elements acting on pressure members 26, 28 located close to the end of the drilling tool opposite drill bit 2. Finally the version according to FIG. 9 shows a design with pressure members 26, 28 acted on by force-transmitting elements, in this case arranged close to the drilling bit end of the drilling tool.

What is claimed:

1. A drilling tool for sinking wells in underground rock formations where the direction of drilling can be selected, comprising:

a tubular outer casing that can be connected to a drill string by means of upper connecting means and which includes a drive shaft that rotates in the outer casing and has a rotary drill bit on the lower end thereof;

a plurality of hydraulically actuated force-transmitting elements associated with hydraulic pressure chambers and arranged around the periphery of the outer casing for generating directional forces with radial force components for guiding the drilling tool;

a control device for the force-transmitting elements including control valve means with drive means for the hydraulic actuation of each force-transmitting element, measured value sensors for position data on the drilling tool and a signal generator that generates control signals for the control valve drive means; and each hydraulic pressure chamber associated with a force-transmitting element being in selective communication with drilling mud of a higher pressure or drilling mud of a lower pressure through connecting channel means and the control valve assigned thereto.

2. The drilling tool according to claim 1, wherein said connecting channel means comprises two connecting channels assigned to each hydraulic pressure chamber of a force-transmitting element such that one connecting channel is connected to drilling mud of a higher pressure, the other connecting channel is connected to drilling mud of a lower pressure, and one of these channels is provided with a control valve.

3. The drilling tool according to claim 1, wherein said connecting channel means comprises a connecting channel connected at one end to drilling mud of a higher pressure and at the other end to drilling mud of a lower pressure and connected between its two ends to the pressure chamber of the force-transmitting element by way of a branch channel.

4. The drilling tool according to claim 1, wherein said drilling mud of a higher pressure comes from a drilling mud channel in the outer casing and said drilling mud of a lower pressure comes from the annular space surrounding the outer casing.

5. The drilling tool according to claim 1, wherein the drilling mud of a higher pressure comes from a drilling mud channel in the outer casing in the direction of flow before reaching a throttle point and the drilling mud of a lower pressure comes from the drilling mud channel below its throttle point.

6. The drilling tool according to claims 4 or 5, wherein the drilling mud channel is provided in the drive shaft.

7. The drilling tool according to claim 1, wherein the drilling mud with a higher pressure comes from the annular space surrounding the outer casing in the direction of flow before reaching a throttle point for the drilling mud passing through the annular space and the drilling mud of a lower pressure comes from the annular space after this throttle point.

8. The drilling tool according to claim 1, wherein the control valve means for controlling the hydraulic action of a hydraulic force-transmitting element is associated with the connecting channel means or portion thereof where the high drilling mud pressure prevails.

9. The drilling tool according to claim 1, wherein the control valve for hydraulic actuation of a force-transmitting element is associated with the connecting channel means or channel portion thereof acted on by drilling mud of a lower pressure.

10. The drilling tool according to claims 8 or 9, wherein the connecting channel means or portion thereof that has no control valve includes a throttle portion.

11. The drilling tool according claim 1, wherein a control valve is provided in said connecting channel means between the hydraulic pressure chamber and both the higher pressure and the lower pressure drilling mud.

12. The drilling tool according to claim 1, wherein one or more of the control valves have valve channels that can be varied only in cross sectional area of flow.

13. The drilling tool according claim 12, wherein one or more of the control valves are provided with a valve body that merely reduces the cross section of flow of the valve channel in its most closed position but does not seal it off entirely.

14. The drilling tool according to claim 1, wherein the drive shaft is mounted so it can be shifted radially in the outer casing from one position to another position by means of force-transmitting elements distributed around the periphery thereof.

15. The drilling tool according to claim 1, wherein the force-transmitting elements act on respective pressure members that can be applied to the wall of the borehole and are arranged at substantially equal peripheral intervals and are supported so they can be expanded or retracted with respect to the outer casing.

16. The drilling tool according to claim 15, wherein the pressure members are designed as stabilizer ribs.

17. The drilling tool of claim 15, wherein the drive shaft is mounted so that it can be shifted radially in the outer casing from one position to another position by means of force-transmitting elements distributed around the periphery thereof.

18. The drilling tool according to claim 1, wherein the force-transmitting elements are disposed in groups, each group including force-transmitting elements connected in parallel to force-transmitting elements in another group.

19. The drilling tool according to claim 18, wherein one of the groups of force-transmitting elements comprises a force-transmitting element group for defining the basic position of the drilling tool in the well, and another of the groups comprises a group for changing the drilling tool orientation.

20. The drilling tool according to claim 19, wherein the force-transmitting elements that define the drilling tool basic position have control parts that can be moved outward to a position that is limited by stops.

21. The drilling tool according to claim 19, wherein the force-transmitting elements that define the drilling tool basic position orient the drive shaft in a centered position relative to the outer casing.

22. The drilling tool according to claim 19, wherein the force-transmitting elements that define the drilling tool basic position orient the outer casing in a centered position in the well by advancing pressure members against the wall of the borehole to an equal extent.

23. The drilling tool according to claim 19, wherein the force-transmitting elements that define the basic position of the drilling tool can be controlled independently of the force-transmitting elements for changing the drilling tool orientation.

24. The drilling tool according to claim 1, wherein the force-transmitting elements include a pressure piston that can move in the hydraulic pressure chamber in the outer casing.

25. The drilling tool according to claim 24, wherein the facing surfaces of the pressure piston and the chamber holding it are protected with a hard coating and the sealing gap between the pressure piston and the wall of the chamber forms the connecting channel or channel part that communicates with the lower pressure drilling mud.

26. The drilling tool according to claim 1, wherein the force-transmitting elements include metal folded bellows as control elements and as elements to define the pressure chamber.

27. The drilling tool according to claim 16, wherein the pressure members that are designed as stabilizer ribs are disposed on projections of the outer casing and their outward movement is limited by a stop.

28. The drilling tool according to claim 14, wherein the force-transmitting elements that act on the drive shaft are arranged proximate the lower end of the outer casing.

29. The drilling tool according to claim 15, wherein the pressure members are arranged proximate the lower end of outer casing.

30. The drilling tool according to claim 15, wherein the pressure members are arranged substantially above the lower end of outer casing, which is provided with fixed stabilizer ribs thereon.

31. The drilling tool of claim 17, wherein the force-transmitting elements associated with the drive shaft may be hydraulically actuated independently of the force-transmitting elements associated with the pressure members.

32. The drilling tool according to claim 19, wherein the force-transmitting elements of the group which determines the basic position of the drilling tool are continuously exposed to a drilling mud pressure and transmit forces less than those transmitted by the force-transmitting elements of the group for changing the orientation of the drilling tool.

* * * * *